US005954348A

United States Patent [19]

Santarsiero et al.

[11] Patent Number: 5,954,348

[45] Date of Patent: Sep. 21, 1999

[54] ROLLER SKATE WITH WHEEL CONTROL MECHANISM

[75] Inventors: Paul Santarsiero, Avon; Salvatore Mucaro, Burlington, both of Conn.

[73] Assignee: Brookfield International, Inc., Toledo, Ohio

[21] Appl. No.: 08/583,572

[22] Filed: Jan. 5, 1996

[51] Int. Cl.[6] ..... A63C 17/14; A63C 17/20

[52] U.S. Cl. ..... 280/11.21; 280/11.2

[58] Field of Search ..... 280/11.19, 11.2, 280/11.21; 188/82.2, 82.3, 82.4, 82.8

[56] References Cited

U.S. PATENT DOCUMENTS

| | | | |
|---|---|---|---|
| 296,833 | 4/1884 | Hanlon | 280/11.21 |
| 864,334 | 8/1907 | Pilz . | |
| 1,481,481 | 1/1924 | Orr | 188/82.3 |
| 2,134,420 | 10/1938 | Smith, Sr. | 188/82.2 |
| 2,812,041 | 11/1957 | Mugler | 188/82.8 |
| 3,790,187 | 2/1974 | Radu et al. | 280/11.21 |
| 4,553,767 | 11/1985 | Robient et al. | 280/11.21 |
| 4,879,821 | 11/1989 | Graham et al. | 36/44 |
| 4,881,624 | 11/1989 | Ulmann | 188/82.2 |
| 4,932,676 | 6/1990 | Klamer | 280/11.21 |
| 5,070,629 | 12/1991 | Graham et al. | 36/27 |
| 5,348,320 | 9/1994 | Gay | 280/11.2 |
| 5,401,039 | 3/1995 | Wolf | 280/11.22 |
| 5,402,588 | 4/1995 | Graham et al. | 36/28 |
| 5,620,190 | 4/1997 | Maggiore | 280/11.21 |

*Primary Examiner*—J. J. Swann
*Assistant Examiner*—Frank B. Vanaman
*Attorney, Agent, or Firm*—Donald R. Fraser

[57] ABSTRACT

A roller skate is disclosed which has three modes of operation. A first mode in which the roller skate may move both forward and backwards, a second mode in which the skate may roll forward only and a third mode in which the skate is prevented from rolling in either direction. A pair of locking rods are disposed in the lower chassis of the skate. The locking rods are adapted to be wedged against a locking surface of a wheel on the skate such to affect the three modes of operation as described.

13 Claims, 5 Drawing Sheets

ROLLER SKATE WITH WHEEL CONTROL MECHANISM

BACKGROUND OF THE INVENTION

1. Field of the Invention

This invention relates to a roller skate having a mechanism which selectively controls the wheels in a variety of different modes of operation.

2. Description of Related Art

Roller skates have been in use for well over 100 years. In that time many patents have been obtained for a variety of improvements on the basic arrangement of four wheels connected to a foot support. Among the improvements to roller skates includes a means for preventing the backward movement of the roller skate wheels which is important and in teaching children to roller skate. By providing such a feature, a beginning skater may more easily learn the first step of skating forward without having to be concerned with inadvertently rolling backwards. Backward motion is considerably more difficult for a beginner skater to control than forward motion, and a skate having a forward only mode of operation is known and useful. U.S. Pat. No. 4,553,767 provides an example of a roller skate designed to facilitate learning to roller skate by preventing a pair of wheels from turning in the rearward direction. In particular, the patent describes a roller skate which is selectively switchable between a first unidirectional mode having two wheels prohibited from rotating in a rearward direction and a second free wheeling mode in which all of the wheels may rotate either forward or rearward.

It may also be desirable, when teaching a beginner how to skate, to have a roller skate with wheels that can be selectively made more resistant to rotating. For example, roller skate coaches often begin training children by using roller skates having wheels secured to the axle by nuts and the coaches tighten the nuts to the point where the wheels will not rotate. Then, as the beginner becomes more adept at roller skating, the wheels are increasingly loosened until the wheels are freely rotating. In this kind of device, a separate wrench, which may get lost or misplaced, is required to lock the wheels on such skates.

Having a beginner skater stand on roller skates with non-rotating wheels, allows the skater to become comfortable with the feel of the skates. A restraint on one or more of the wheels, enables the beginner skater to start "skating" by walking on the skates. For more advanced skaters, on the other hand, being able to lock one or more of the wheels can be useful for example, in climbing stairs.

A conventional ratchet and pawl arrangement which prevents rearward motion of the wheels has been used for many years. For example, a loosely pivoting pawl drawn downwardly by the force of gravity is disclosed in U.S. Pat. No. 864,334, issued Aug. 27, 1907. The pawl engages a ratchet mounted to a wheel so that the roller skate will move only in the forward direction. The skate also has an attachment for securing the pawl out of alignment with the ratchet portion so that the wheel may freely move when desired.

More recently, U.S. Pat. No. 4,553,767, issued Nov. 19, 1985, and U.S. Pat. No. 4,932,676, issued Jun. 12, 1990, each disclose a more intricate internal mechanism for preventing backward rotation of at least one wheel of a roller skate. Both designs, however, are susceptible to a variety of problems. For example, the pawl in both arrangements extend below the plane defined by the axles. The pawl engages a plurality of teeth located on an inner surface of the wheel formed by a coaxial channel with the riding surface of the wheel. The channel significantly reduces the strength of the wheel, making it more susceptible to deformation than a solid or internally webbed wheel. Any deformation could prevent the pawl from engaging the teeth, thus defeating the purpose of the whole ratchet and pawl mechanism.

Another problem with the arrangement shown in the above-mentioned patents is the pawl extends below the plane formed by the axles. The pawl is more susceptible to jamming or unwanted movement in either the upward or downward position because of dirt, rocks or mud than any arrangement wherein the pawl never extends below the plane.

SUMMARY OF THE INVENTION

According to the preferred embodiment of the invention, there is provided a roller skate which includes a body, a plurality of wheels rotatably mounted on the body and at least one wheel having a circumferential locking surface. The body has an arcuate surface disposed adjacent the circumferential locking surface and forms a crescent shaped space therebetween. The wheels are locked by a locking assembly which includes a wedge which is positioned within the crescent shaped space, the wedge moves between a first wedge position located between the locking surface and the arcuate surface in which the wheel is prevented from rotating in any direction and a second wedge position in which the wheel is able to rotate along the direction. In one aspect of the invention, the locking surfaces of the wheel is disposed radially inward of a ground contacting surface of the wheel. Additionally, according to the present invention, the roller skate locking assembly may further include a second wedge which is positionable within the crescent shaped space, the second wedge may be movable between a first position that prevents rotation of the wheel in a second direction, which is opposite the first direction, and a second position which allows the wheel to rotate in the second direction. In still a further aspect of the invention, the wheel locking assembly may include a lever which is movable between two positions: a first position in which the wedge is in the first wedge position and a second position in which the wedge is in the second wedge position. Also according to the invention, the wheel locking assembly may be movable between three positions and the lever may be movable between three positions.

The invention also provides a skate which is selectively actuable between a plurality of modes of operation. The skate comprises a main body, a plurality of wheels rotatably attached to the body, and least one wheel having a first wheel locking surface. A locking rod is supported by the body and is movable between a position contacting the first locking surface and a position not contacting the first locking surface. The body includes a second locking surface which is positioned proximate the rod. The second locking surface of the body cooperates with the rod to enable the rod to prevent the rotation of the wheel in at least one direction. The skate may be provided with a locking lever which is movable between two positions, a first position which provides the wheels with a first mode of rotation and a second position which provides the wheels with a second mode of rotation.

Finally, the present invention provides a roller skate which provides three modes of operation. The skate comprises a main body, a plurality of wheels that are rotatably attached to the body, and at least one wheel having a locking surface. A pair of locking rods which are supported by the body move between a position contacting the locking surface and a position not contacting the locking surface. A fender is attached to the body and positioned proximal to the locking surface of the wheel and forms a crescent shaped space therebetween, the crescent shaped space has a first dimension and a second dimension. The first dimension of the crescent space is greater than the diameter of the rods and the second dimension is less than the diameter of the rods. A locking lever is movable between three positions, a first position in which both rods are prevented from being wedged between the fender and the locking surface thereby allowing bi-directional or free rotation, a second position where one rod is prevented from being wedged between the fender and the locking surface thereby allowing unidirectional rotation and a third position where neither rod is prevented from being wedged between the fender and the locking surface thereby preventing rotation of the wheel.

Various aspects of this invention include providing each rod with a knurled circumferential surface along a portion in alignment with each wheel to facilitate the gripping of the locking surface of the wheel. Further, at least one wheel may have a circumferential ground contacting surface and the locking surface of the wheel may be disposed radially inwardly from the ground contacting surface. Additionally, the body may include a front, a rear, and a transverse dimension where the plurality of wheels may include two wheels disposed along the transverse dimension of the skate, the two wheels being rotatable along an axis in the transverse dimension. The first dimension of the crescent shape is disposed at a vertical line extending from the wheel axis, and the rod which prevents the movement of the skates in the rearward direction is disposed rearward of the line. Additionally, the skate may include a locking lever that is spring-loaded and indexable between the first, second and third positions.

Further objects and advantages of the present invention appear in the detailed description taken in conjunction with the accompanying drawings, in which:

DETAILED DESCRIPTION OF THE INVENTION

Figure 1:
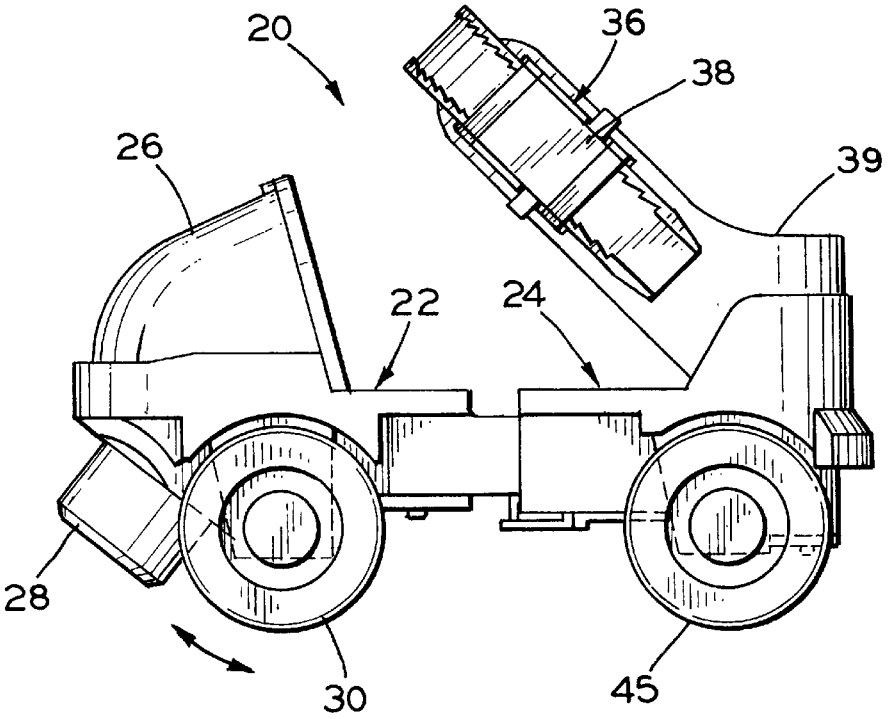
FIG. 1 is a side plan view of a roller skate of the present invention.
Figure 2:
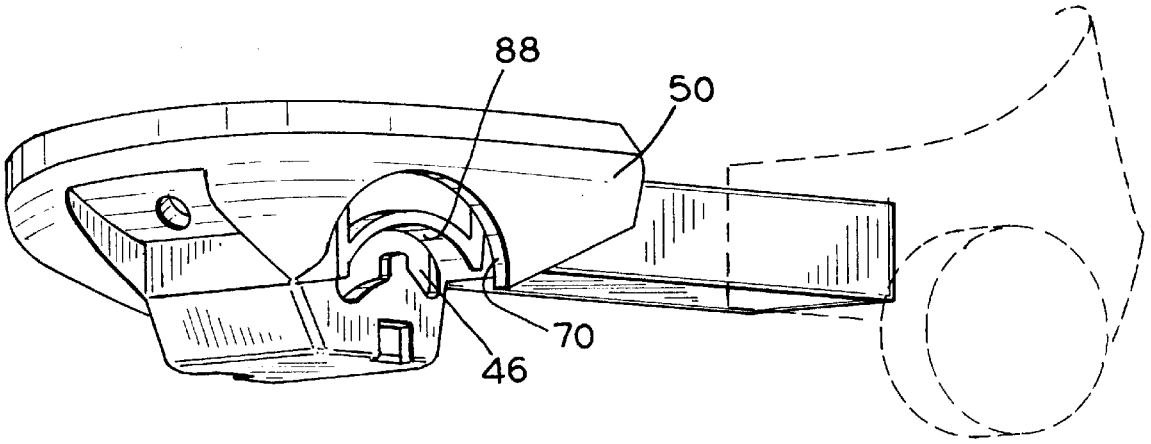
FIG. 2 is a perspective view of the front chassis of a roller skate of invention, other components of the roller skate are shown in phantom.
Figure 3:
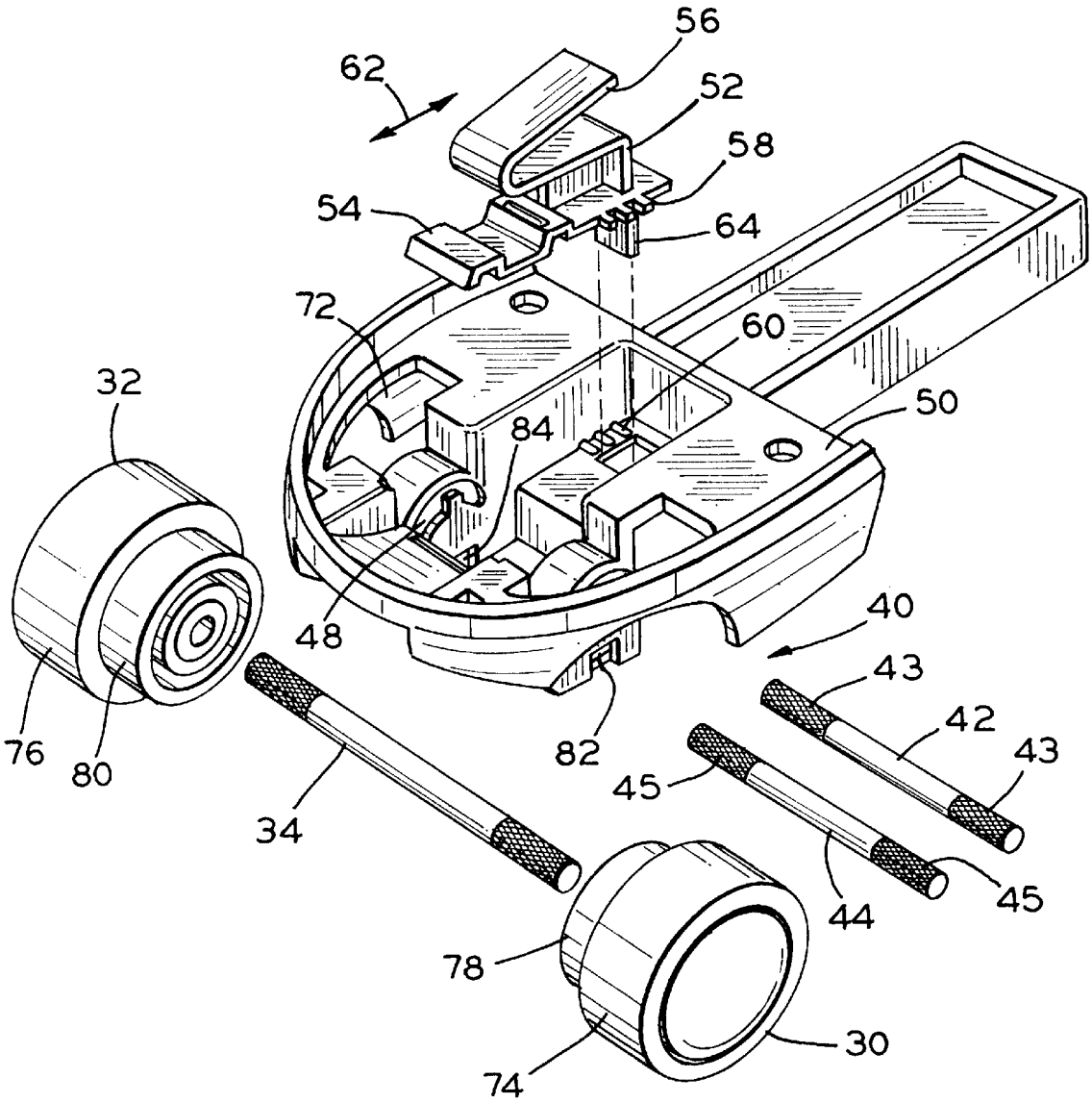
FIG. 3 is an exploded detail view of the front chassis of a roller skate according to the present invention illustrating the locking mechanism components.

With reference to FIGS. 1–3, a roller skate 20 comprises two sections, a front section 22 and a rear section 24. The front section, as seen in FIG. 1, includes a toe cap 26, a toe stop 28, and a front wheel 30. As shown in FIG. 3, the preferred embodiment has a second front wheel 32 which is connected to the wheel 30 by an axle 34. The rear section 24, shown in FIG. 1, includes an ankle fastener 36 which supports a buckle assembly 38, a heel cup 39, and a pair of rear wheels, of which only wheel 45 is shown.

In accordance with a preferred embodiment of the present invention, a locking mechanism, indicated generally by 40, is provided to lock the front wheels 30 and 32 in one of three modes of rotation: a first mode which allows for free (bidirectional) rotation, a second mode which allows for unidirectional rotation, and a third mode which does not allow for any rotation. As shown in FIG. 3, the locking mechanism includes a pair of wedges, in this case as shown as locking rods 42, 44 which are aligned parallel with the axle 34 and are supported by apertures 46 and 48 in a lower chassis 50 of the front section 22. Aperture 46 is shown in FIG. 2 and aperture 48 is shown in FIG. 3. The circumferential surface of the ends of rods 42 and 44 selectively wedge against the wheels 30, 32 to prevent rotation of the wheels in one or both directions. A front section 54 of a lever 52 having steps and ramps controls the position of the rods which effects the three modes of rotation of the wheels. The lever 52 includes an extension 56 disposed at the top which forms a leaf spring and a plurality of indexing protrusions 58 on each lateral side of the lever 52. The indexing protrusions 58 cooperate with similarly sized protrusions 60 on the chassis so that the lever may be indexed in forward and rearward directions as indicated in FIG. 3 by arrow 62. A tab 64 extends through the bottom of the chassis and enables a person to move the lever forward and rearward. When the lever is selectively indexed, the rods 42 and 44 are selectively prevented from wedging against the wheel to effect the three modes: no rotation, unidirectional rotation and bidirectional rotation. Each aspect of the invention is more particularly described below.

Again with reference to FIGS. 2 and 3, the lower chassis 50 of the front section includes wheel wells 70 and 72 for the wheels 30, 32, respectively. The wheels 30 and 32 preferably have stepped circumferential surfaces. The outer circumferential surfaces 74, 76 of each wheel 30, 32, respectively, are intended to contact the ground. Circumferential locking surfaces 78 and 80 are provided on the inboard portion of each wheel. The diameter of the wheels at the circumferential locking surfaces is smaller than the diameter of the wheel at the ground contacting surface. Each wheel is attached to the axle 34 which is supported by the chassis 50 through apertures 82 and 84. The axle 34 has knurled surfaces to frictionally engage the wheels 30 and 32. The chassis also includes a fender 88 which is disposed radially outward of the locking surface of the wheel when the wheel is attached to the chassis. As described with reference to FIGS. 7–9, the fender cooperates with the locking surface and the rods to effect the three modes of wheel rotation.

Figure 4:
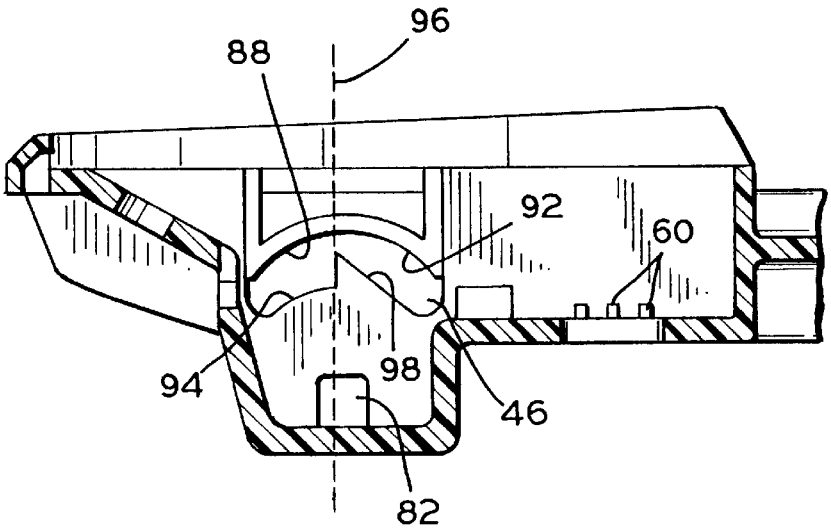
FIG. 4 is a detail sectional view of the front chassis of the present invention.

The rods 42, 44 have knurled ends 43, 45 at their circumferential surface which facilitate engagement with the locking surface. The rods are disposed parallel to the axle 34 and are supported by chassis 50 through apertures 46 and 48. The apertures guide the movement of the rods toward and from the locking surfaces. As seen in FIG. 4, the aperture 46 (the aperture 48 is similar) has an arcuate upper surface 92. The lower surface of the apertures 46, 48 is discontinuous and includes an arcuate curve 94 at the front which extends to a vertical line 96 from the center line of the axle 34. The lower surface of the aperture 46 rearward of the line 96 is a straight surface 98 which inclines downward in the direction toward the rear of the skate.

Additionally, discontinuous surfaces 94 and 98 restrict the movement of the rods 42 and 44 in their respective slots or housings. Preferably rod 42 is located in the rearward side of the line 96 and rod 44 is located forward of the line 96. In the preferred embodiment, the rods should never cross over line 96.

The rods 42, 44 are moved away from the locking surface of the wheel by the front portion 54 of the lever 52. The upper surface of the front portion includes a surface 102 that contacts the rod 44 to distance the rod 44 from the wheel. Similarly, surface 104 is positioned on the front portion to force to the rod 42 away from the wheel. When the rods are disposed in a position not engaging the locking surface of the wheels, the wheels are able to freely rotate. The lever is indexed between the three positions by the tab portion 64 and locked into place by the cooperation of the protrusion 60 on the chassis 50 and the laterally extending protrusions 58 on the lever. In a preferred embodiment three protrusions are desirable. Of course, one skilled in the art would recognize that more or fewer protrusions may be suitable for any given locking mechanism.

Figure 5:
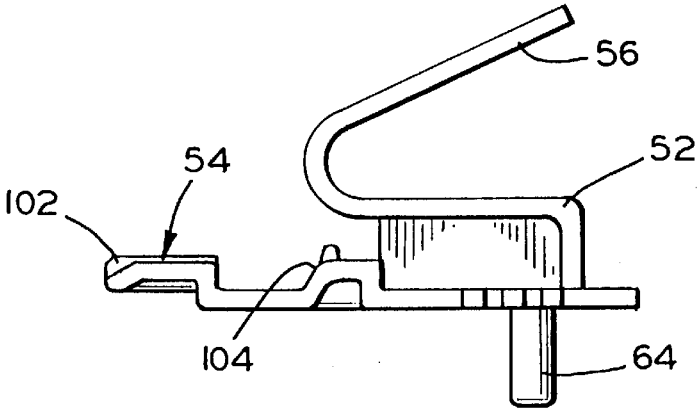
FIG. 5 is a side and bottom view, respectively, of the adjustment lever in accordance with the present invention.
Figure 6:
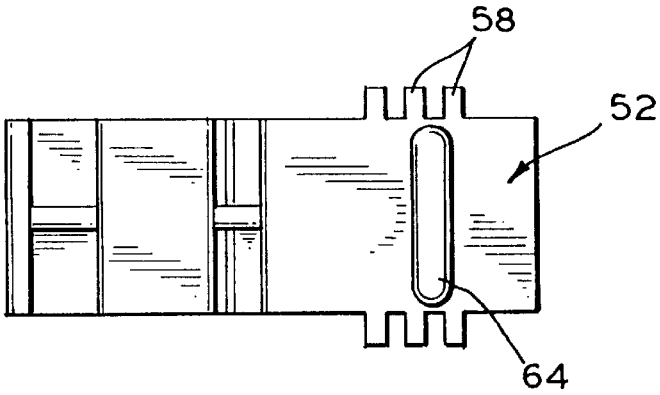
FIG. 6 is a side and bottom view, respectively, of the adjustment lever in accordance with the present invention.

When an operator desires to move the lever from one position to another, the operator simply presses the tab 64 to disengage the protrusions 58 from the protrusions 60 so that the lever may move forward or rearward as desired. Once the lever is in the desired position, the lever reengages the protrusions 60 to be locked in place by means of the extension 56, which forms a downwardly biasing leaf spring. The extension 56 provides enough biasing force to maintain the lever in a desired position during rough and jarring movements commonly associated with roller skating. The biased extension 56, however, must still permit one to disengage the protrusions 58 and 60 from one another. The spring shown in FIG. 5 is in its unbiased configuration. After installation, the spring is biased against the top part of the front section 22, as illustrated in FIGS. 7–9.

Figure 7:
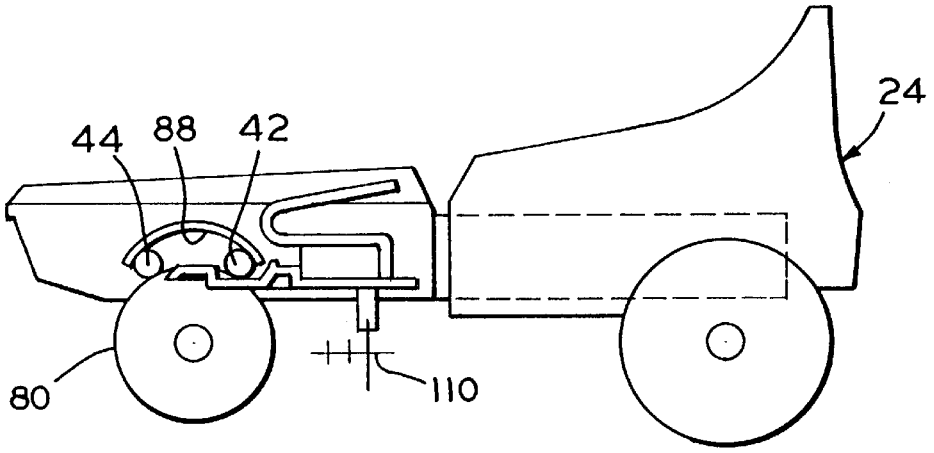
FIG. 7 illustrates a perspective view of the locking mechanism in a two-way locking position which locks the wheels against motion.
Figure 8:
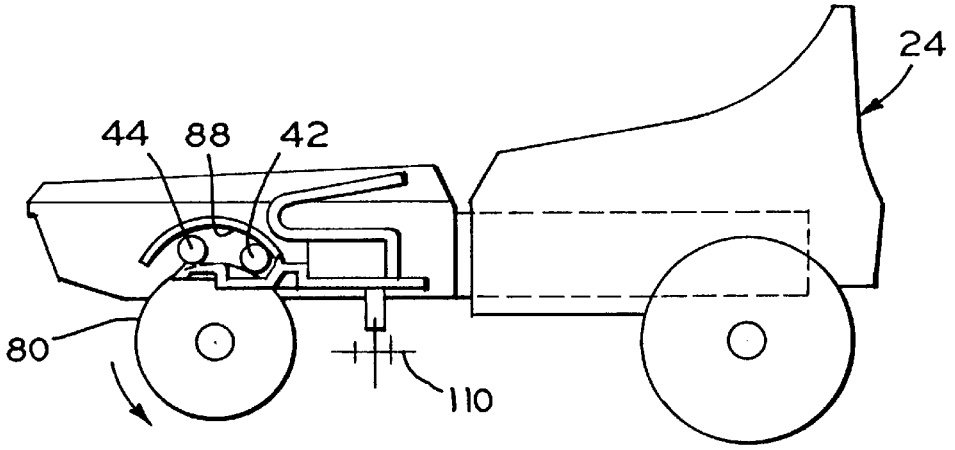
FIG. 8 illustrates a perspective view of the locking mechanism in a one-way locking which allows for one directional rotation.
Figure 9:
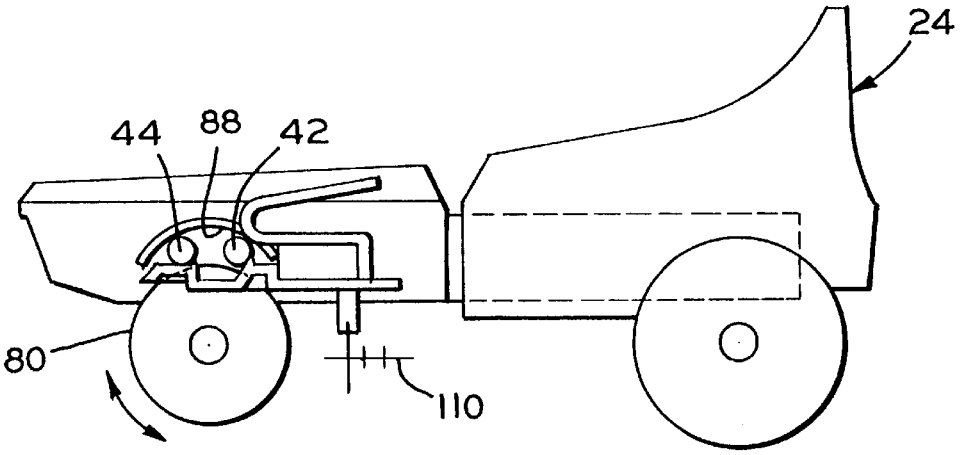
FIG. 9 illustrates a perspective view of the locking mechanism in a one-way locking which allows for free wheeling rotation.

The operation of the locking mechanism which produces the three modes of wheel rotation is illustrated in FIGS. 7–9. The fender 88 forms a crescent shaped space in which the knurled ends of the rods 42 and 44 are disposed. FIG. 7 illustrates the first mode of wheel rotation and shows the wheels locked against rotation in both directions. The lever is indexed at its rearward most position as represented by the graduated line 110. In this position, neither rod 42 or 44 is separated from the locking surface 78. Accordingly, the rod 44 becomes wedged between the fender 88 and the locking surface of the wheels when the skate is moved in the forward direction, thus preventing substantial rotation of the wheel in that direction. Typically, only a slight forward movement is required to wedge the rods between the fender and the surface of the wheels, thereby precluding the wheel from moving counterclockwise. Similarly, if one were to attempt to move the roller skate backwards, the rod 42 would become wedged between the fender 88 and the locking surface 78 of the wheel, thus preventing any further rotation of the wheel and any backward motion of the skate.

In the second mode of wheel rotation shown in FIG. 8, the locking mechanism is positioned by moving the tab 64 to the second, or middle, position of the graduated line 110. In this position, the lever has moved forward sufficiently to engage along surface 102 the rod 44 and lift the rod 44 above the locking surface 78. The rod 44 is displaced into a position of the crescent shaped space proximate the line 96. Note that the rod 42 is still in contact with the locking surface of the wheel. In this position, the lever prevents the rod 44 from becoming wedged between the fender 88 and the locking surface 78. Thus, when the skate begins to move backwards the rotation of the wheel will wedge the rod 42 between the fender 88 and the locking surface 78 preventing any backward motion of the roller skate.

FIG. 9 shows a third position of the lever. In this position, the tab 64 is in a third, or forward, position as indicated by the graduated line 1 10. When the tab is in the forward position, both rods 42 and 44 are separated from the locking surface by the forward end of the lever 52 and prevented from being wedged between the fender and the locking surface. More particularly, the rods 42 and 44 are both raised above the locking surface by the lever surfaces 102 and 104 respectively. In this position, neither rod is able to become wedged between the fender and the locking surface of the wheel. Thus, free rotation of the wheel is available and a roller skater can enjoy the full, unencumbered rotation of the wheels.

Figure 10:
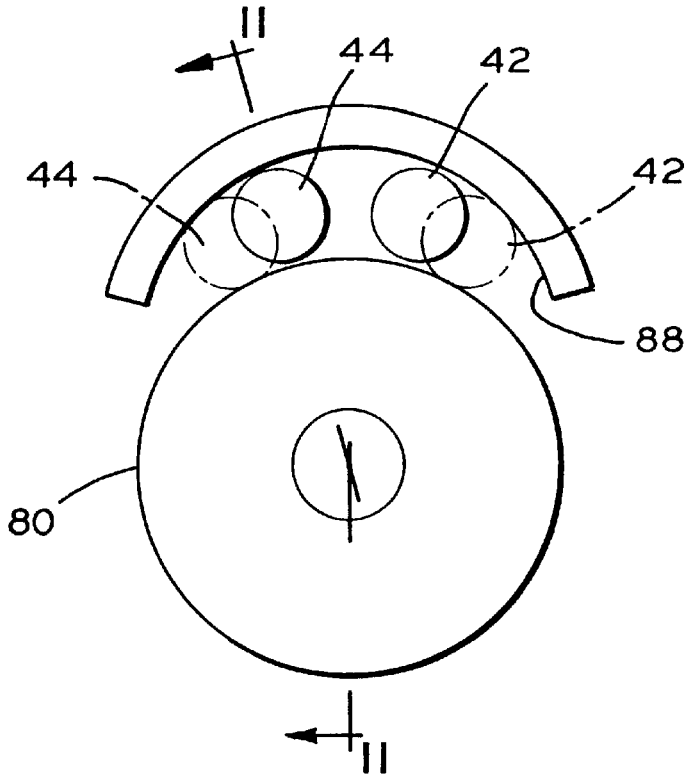
FIG. 10 is a detailed side view of the wheel and rods and the fender of the chassis illustrating each rod in two positions; and, FIG. 11 is a sectional view taken along sectional lines 11—11 in FIG. 10.
Figure 11:
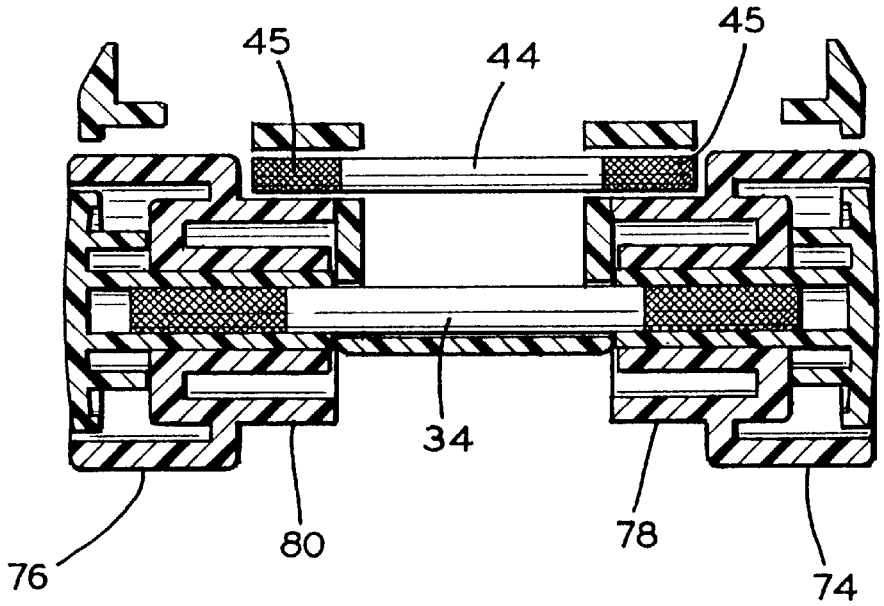

FIGS. 10 and 11 show schematic views of the fender and the locking surface of the wheel. In FIG. 10, the crescent shaped area between the fender 88 and the locking surface 78 is illustrated. When the lever is in the first, rearward position (FIG. 7), the rods 42 and 44 are positioned as shown in phantom. When the lever is in the second, middle position (FIG. 8), rod 42 is in the position shown in phantom and rod 44 is in the position shown in solid lines. When the lever is in the forward position (FIG. 9), the rods 42 and 44 are in the position shown by solid lines. The movement within the crescent shaped space away from the locking surface and towards the line 96 is shown as the wheels move in the disengaged position. With reference to FIG. 11, which shows the two-step wheel construction and the relative position of the rods with the axial 34.

While the overall roller skate 20 is preferably made from plastic, the type of plastic may vary for each element. For example, the wheels 30, 32 should be formed of a strong durable plastic capable of withstanding forces from both the user and the skating surface. The wheels should also be gouge resistant to maintain an even outer surface for smooth skating. The locking surface should be hard enough not to degrade after extended use of the locking mechanism. In particular, material selected for the locking surface should be able to withstand the force of contact between the locking surface and the knurled rod, however it should not be so hard as to prevent the knurled surfaces of the rod from being wedged between the fender and the locking surface of the wheel.

The rods can be made of any suitable material which may be wedged between the fender and the wheel locking surface without adversely affecting the rod. In a preferred embodiment of the invention, the rods are made of steel. The circumferential surfaces at each end of the steel rods are knurled using conventional techniques to increase the friction coefficient of the rod so that the rod may become wedged between the fender and the locking surface more easily. The lever mechanism is preferably made of any suitable plastic. The plastic should have a suitable spring coefficient to provide biasing force to the lever.

Various changes and modifications to the embodiment disclosed above and shown in the drawing may be made within the scope of this invention. For example, the locking mechanism may be positioned at the rear wheel assembly. Additionally, one may use a single rod to prevent rearward motion of the wheels in a two mode operation wherein a first mode is the free wheeling or bidirectional rotation and the second mode is a unidirectional motion. Preferably wheel motion is maintained such that the skate moves in the forward direction. In the embodiment shown, a separate locking surface is provided. Of course, it is within the scope of the invention to use the ground contacting surface of the wheels to also provide the locking surface. Additionally, it is within the scope of this invention to use a fully separate wheel for the locking surface instead of ground contacting wheels. Thus, it is intended that the above description as shown and described are presented by way of example only and are intended to be interpreted as illustrative and not in a limiting sense.

What is claimed is:

1. A roller skate selectively actuable between multiple modes of operation, the skate comprising:

a main body;

a plurality of wheels rotatably attached to the body, at least one wheel having a locking surface;

a pair of locking rods having a diameter and being supported by the body to move between a position contacting the locking surface and a position not contacting the locking surface;

a fender attached to said body and positioned proximate the locking surface of the at least one wheel and forming a crescent shaped space therebetween, said crescent shape having a first dimension and a second dimension, said first dimension being greater than the diameter of the rods and the second dimension being less than the diameter of the rods;

a locking lever movable between three positions, a first position in which both rods are prevented from being wedged between the fender and the locking surface thereby allowing bidirectional rotation, a second position where one rod is prevented from being wedged between the fender and the locking surface thereby allowing unidirectional rotation, and a third position where neither rod is prevented from being wedged between the fender and the locking surface, thereby preventing rotation of the wheel.

2. The skate of claim 1, wherein each rod includes a circumferential surface at at least one end, said at least one end having a roughened surface that facilitates gripping the locking surface of the wheel.

3. The skate of claim 1, wherein at least one wheel has a circumferential ground contacting surface and the locking surface of the wheel is radially inwardly disposed from the ground contacting surface.

4. The skate of claim 1, wherein the body has a front, a rear and a transverse dimension, and wherein the plurality of wheels includes two wheels disposed along the transverse dimension of the skate, the two wheels being rotatable along an axis in the transverse dimension, the first dimension of the crescent shape being disposed forward of a vertical line extending from the axis, and one of said rods is disposed rearward of the line when said locking lever is in said second position.

5. The skate of claim 1, wherein the locking lever is spring loaded and indexable between the first, second and third positions.

6. The skate of claim 1, wherein the body has a front, a back and a transverse dimension, the body having an aperture open along a direction perpendicular to the transverse dimension, the rods extending through said aperture and being supported by the body, the apertures allowing movement of the rods between the fender and the wheel locking surface.

7. The skate of claim 1, wherein the body includes an inboard side and an outboard side, and wherein the fender and the locking surface are disposed on the inboard side with respect to the ground contacting surface of the wheel.

8. A skate which is selectively actuable between a plurality of modes of operation, the skate comprising:

a main body;

a plurality of wheels rotatably attached to the body, at least one wheel rotatably attached to the body by an axle and having a first locking surface;

at least one locking rod having a length and a diameter and being supported by the body, said rod length being in a substantially parallel position to said axle and said rod being movable in a direction transverse to its length between a position contacting the first locking surface and a position not contacting the first locking surface;

the body having a second locking surface positioned proximate the rod, said second locking surface of the body cooperating with the at least one rod to enable the at least one rod to prevent the rotation of the wheel in at least one direction; and, a locking lever movable between at least two positions, a first position which provides the wheels with a first mode of rotation and a second position which provides the wheel with a second mode of rotation.

9. The roller skate of claim 8, wherein the first position is a position wherein the wheel is locked, and the second position is a position where the wheel is able to rotate in one direction.

10. The roller skate of claim 8, wherein the first position is a position where the wheel is able to move bi-directionally and the second position is a position wherein the wheel is able to rotate in a unidirectional rotation.

11. The roller skate of claim 10, further comprising a second rod and wherein the locking lever is movable into a third position, the third position allowing the wheel to rotate in both directions.

12. The roller skate of claim 8, wherein the wheel includes a circumferential ground contacting surface, said ground contacting surface being disposed radially outward of the first locking surface.

13. A roller skate comprising:

a body;

a plurality of wheels rotatably mounting onto the body, at least one wheel having a circumferential locking surface, said body having an arcuate surface disposed adjacent said circumferential locking surface and forming at least a partially crescent shaped space; and a locking assembly including a wedge element positionable within the at least partially crescent shaped space, said wedge moving between a first wedge position between the locking surface and the arcuate surface in which the wheel is prevented from rotating in a first direction, and a second wedge position in which the wheel is able to rotate in the first direction and said locking assembly includes a second wedge which is positionable within the at least partially crescent shaped space, said second wedge movable between a first position which presents rotation of the wheel in a second direction opposite the first direction, and a second position which allows the wheel to rotate in the second direction.

* * * * *